United States Patent [19]

Katahira et al.

[11] Patent Number: 4,854,371

[45] Date of Patent: Aug. 8, 1989

[54] TWIN BELT TYPE CONTINUOUS CASTING MACHINE

[75] Inventors: Keiichi Katahira; Kiyomi Shio, both of Kitakyushu; Noriyuki Kanai, Oita, all of Japan

[73] Assignee: Nippon Steel Corporation, Tokyo, Japan

[21] Appl. No.: 287,240

[22] Filed: Dec. 21, 1988

[51] Int. Cl.[4] ..... B22D 11/06

[52] U.S. Cl. ..... 164/431; 164/436

[58] Field of Search ..... 164/431, 430, 436, 481, 164/491

[56] References Cited

FOREIGN PATENT DOCUMENTS 59-189047 10/1984 Japan .
60-203345 10/1985 Japan .
61-279341 12/1986 Japan .
62-259643 11/1987 Japan ..... 164/431

*Primary Examiner*—Nicholas P. Godici

*Assistant Examiner*—J. Reed Batten, Jr.

*Attorney, Agent, or Firm*—Pollock, Vande Sande & Priddy

[57] ABSTRACT

A continuous casting mahcine has a mold of a rectangular cross-section having short sides formed by parallel runs of a pair of metallic belts and short sides constituted by parallel runs of a pair of endless loops each comprising a plurality of dam blocks. The parallel runs of each endless loop are guided by inner and outer guide rails sandwiched between the edges of the parallel runs of the metallic belts and moved in the same direction as the movements of the metallic belts and substantially in synchronism therewith. So as to vary the widthwise dimension of a slab to be cast by the mold, the inner and outer guide rails are independently movable. The endless loop comprises first and second groups of dam blocks which groups are respectively shifted widthwise of the slab by one of the guide rails and by the other guide rail, whereby the width of the slab can be varied perpendicularly to the length of the slab being cast.

9 Claims, 1 Drawing Sheet

TWIN BELT TYPE CONTINUOUS CASTING MACHINE

BACKGROUND OF THE INVENTION

The present invention relates to a twin belt type continuous casting machine and, more particularly, to a twin belt type continuous casting machine constructed to enable the width of a thin slab (referred to hereunder as "slab") of a metal to be varied perpendicularly to the length of the slab, i.e., without requiring a substantial length of width-varying zone, while the slab is continuously cast by the machine.

DESCRIPTION OF THE PRIOR ART

In recent years, various continuous casting machines have been proposed which are each operative to produce directly from molten steel a thin slab of several mm to several tens mm in thickness having a shape close to that of a desired final steel product. Because the continuous casting machines of this kind are capable of reducing the number of the manufacturing steps and saving certain parts of the installation, the casting machines advantageously contribute to the saving of energies, the reduction in the installation costs, the improvements in the casting yield and improvements in the controllability of the quality of the products. Accordingly, many efforts are being made by those in the art to develop and improve the casting machines of the class referred to above.

The twin belt continuous casting machine which is the subject matter of the present invention is one kind of the continuous casting machines referred to above.

An example of vertical type twin belt continuous casting machines is proposed in Japanese Unexamined Patent Publication No. 61-279,341.

In the early part of the development of such twin belt continuous casting machines, it was impossible to vary the width of a thin slab during a continuous casting thereof, as in the case of the continuous casting machines for thicker slabs, i.e., slabs each having a thickness of about 300 mm.

An example of such early continuous casting machines is proposed in Japanese Unexamined Patent Publication No. 59-189,047. Japanese Unexamined Patent Publication No. 60-203,345 discloses a continuous casting machine which is improved to enable the width of a thin slab being cast to be varied.

The proposal in the Japanese Unexamined Patent Publication No. 59-189,047 is a method which is carried out by use of a continuous casting machine in which the longer sides of a casting mold are formed by parallel runs of a pair of endless belts of a metal and the shorter sides of the mold are formed by two rows of upper and lower mold members When it is required to vary the width of a slab being continuously cast, the pouring of molten steel into the mold is interrupted to lower the meniscus to a level within the lower mold members. Then, the upper mold members are shifted to vary the widthwise dimension of the mold Thereafter, the pouring of the molten metal is resumed.

The method is disadvantageous in that the interruption of the pouring not only lowers the productivity but also causes a change in the slab-drawing speed which in turn causes a variation in the cooling condition of the cast slab which further in turn causes a variation in the condition of solidification with the result that the condition of preventing the production of impurities in the molten steel and the condition for the floating thereof, which are factors of the control of the quality of steel products, are varied to undesirably fluctuate the quality of the steel products.

This problem is solved by the proposal by the Japanese Unexamined Patent Publication No. 60-203,345 in which inclined guide rails, parallel guide rails, shifting members for moving the guide rails and means for driving the shifting members are provided to form a slab-width varying mechanism which is disposed upstream of a position where short-side mold members are sandwitched between runs of a pair of endless belts of metal. In order that the width of a slab may be varied, the speed Vg of the parallel guide rails is adjusted to satisfy the conditions given by:

$$h/Vg > l/Vc \quad (1)$$

$$Vg < Vc \cdot h/l \quad (2)$$

where Vc is the casting speed, h is the dimension of the short-side mold members measured in the widthwise-direction of slab and l is the width of the short-side mold members measured in the thicknesswise direction of slab. The shoft-side mold members are moved to positions where they are sandwitched between runs of the metallic belts, to thereby vary the width of a slab being cast. The mold members thus moved are held by the gripping force of the metallic belts while the mold members are sandwitched between the belts.

In the apparatus proposed in Japanese Unexamined Patent Publication No. 60-203,345, however, the length L of the slab-width varying zone formed by the inclined guide rails and the parallel guide rails is the sum of the dimensions A and B, as shown in FIG. 4 of the publication. In addition, the apparatus is structured such that the meniscus of the poured molten steel is located within the slab-width varying zone. Accordingly, in the process of reducing the slab width in the inclined type continuous casting machine disclosed in Japanese Unexamined Patent Publication No. 60-203,345, the shell formed by the solidification of molten steel by the time when the short-side mold members moved to reduce the slab width become to be gripped by the metallic belts is depressed by the widthreducing short-side mold members by a dimension corresponding to the required reduction in the slab width, with a resultant formation of wrinkles in the side and under surfaces of the slab. Due to such wrinkles, surfaces defects are formed in the final products.

On the other hand, when the slab width is increased, a new shell is formed on the outer surfaces of the shell already formed by the solidification of molten steel by the time when the short-side mold members moved to increase the slab width become to be gripped by the metallic belts. Thus, the resultant slab has a double-layered surface which also results in the formation of surface defects in the final products.

With the inclined type continuous casting machine proposed in Japanese Unexamined Patent Publication No. 60-203,345, therefore, it is impossible to vary the slab width at such a high speed as is approximately equal to Vc given in the above equations (1) and (2). Thus, the slab width varying speed of the machine proposed in the last-mentioned Japanese publication could be as high as approximately from Vc/100 to Vc/1000 which is substantially equal to the slab width varying speed in the case of the conventional continuous casting machine capable of continuously casting a slab of 300 mm in thickness. For the above reasons, there has long been a demand for a continuous casting machine having a mold which is structed to meet the conditions given by the above equations (1) and (2); namely, which is operative to vary the width of a slab in a direction substantially perpendicular to the length of the slab being cast.

It is, therefore, an object of the present invention to provide a twin belt type continuous casting machine which is capable of meeting the demand pointed out above.

SUMMARY OF THE INVENTION

The twin belt type continuous casting machine according to the present invention is of the type that includes a pair of endless belts movable in the directions of their lengths and a pair of endless side dam loops each formed by a plurality of short-side dam blocks and movable in the direction of the length of the loop. The endless belts have spaced and substantially parallel runs movable in the same directions. The endless side dam loops have spaced and substantially parallel runs each sandwitched between adjacent side edges of the parallel runs of the endless belts and movable substantially in synchronism therewith. The parallel runs of the endless belts and the parallel runs of the endless side dam loops cooperate together to form a continuous casting mold having a substantially rectangular cross-section. The endless belt parallel runs and the endless side dam loop parallel runs constitute the long side faces and the short side faces of the mold, respectively. The mold continuously receives molten metal to cast a thin and continuous slab.

The present invention provides an improvement in the continuous casting machine of the type referred to above. The improvement comprises a pair of substantially endless inner and outer guide rails for guiding the endless side dam loops, respectively, rail moving means for shifting the inner and outer guide rails independently to shift the runs of the endless side dam loops in the widthwise directions of the slab being cast, each of the pair of endless side dam loops comprising a first group of dam blocks guided by at least one of the inner and outer guide rails and a second group of dam blocks guided by at least the other guide rail, the first and second groups of dam blocks being connected to form the endless loop, the groups of dam blocks being formed by short-side dam blocks of a number extending over a dimension longer than a dimension required for the dam blocks to contact with the slab, first and second short-side dam block support means for engaging the first and second groups of short-side dam blocks with associated guide rails so that the short-side dam blocks are supported by the guide rails, the inner and outer guide rails being movable by the rail moving means to respectively shift, through the first and second short-side dam block support means, the first and second groups of short-side dam blocks in directions widthwise of the slab, said inner and outer guide rails and said first and second short-side dam block support means being arranged such that pressures applied by the metal being cast and by a cast slab to the short-side dam blocks in contact with the metal and the slab are transmitted to the inner and outer guide rails substantially along a plane extending through a substantially thicknesswise center of the slab and substantially in parallel with the widthwise direction of the slab.

Because the continuous casting machine according to the present invention is improved in the manner set forth above, the first and second groups of short-side dam blocks can be shifted widthwise of the slab, respectively, to vary the width of the slab substantially perpendicularly to the length of the slab, i.e., without forming a long width-varying zone. In addition, because the machine employs a mechanism which assures that pressures applied by the metal being cast and by a cast slab to the short-side dam blocks in contact with the metal and the slab are transmitted to the inner and outer guide rails substantially along a plane extending through a substantially thicknesswise center of the slab and substantially in parallel with the widthwise direction of the slab, the inner and outer guide rails and the first and second short-side dam block support means are not subjected to forces which are unbalanced with respect to afore-said plane. Accordingly, when the slab width is varied, these mechanical elements are smoothly movable, do not suffer from unbalanced wear and do not produce undesirable noise.

According to an embodiment of the present invention, the first and second short-side dam block support means comprise parts of a length of chain. The chain parts are connected together by lost motion connection means to form an endless chain. The lost motion connection means are arranged such that two adjacent chain parts connected by the lost motion connection means are relatively movable substantially perpendicularly to the direction of the movement of the endless chain.

According to another embodiment of the invention, the one group of short-side dam block is guided by both of the inner and outer guide rails. The first and second short-side dam block support means comprises parts of a length of chain. The chain parts are connected to form an endless chain. The chain part which is associated with the one group of short-side dam blocks is expansible and contractible in a direction substantially perpendicular to the direction of movement of the endless chain.

The above and other objects, features and advantages of the present invention will be made more apparent by the following description with reference to the accompanying drawings.

DESCRIPTION OF PREFERRED EMBODIMENTS

Figure 1:
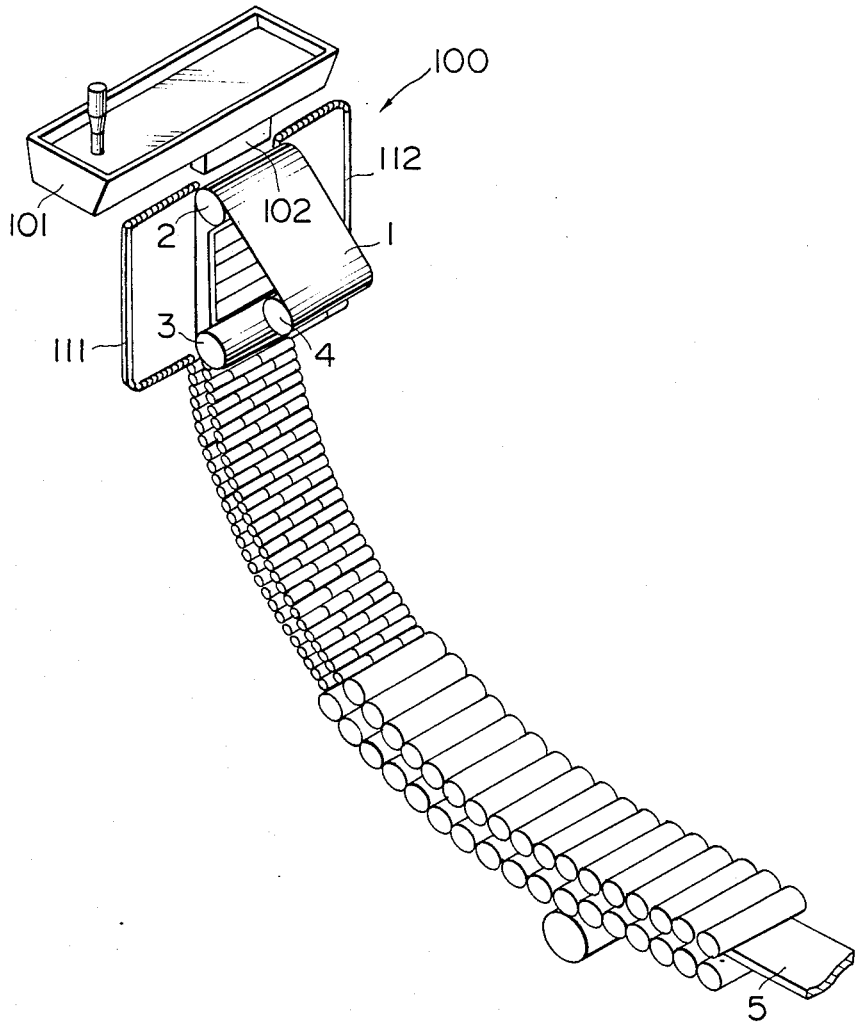
FIG. 1 is a schematic perspective view of an embodiment of the twin belt type continuous casting machine according to the present invention.
Figure 2:
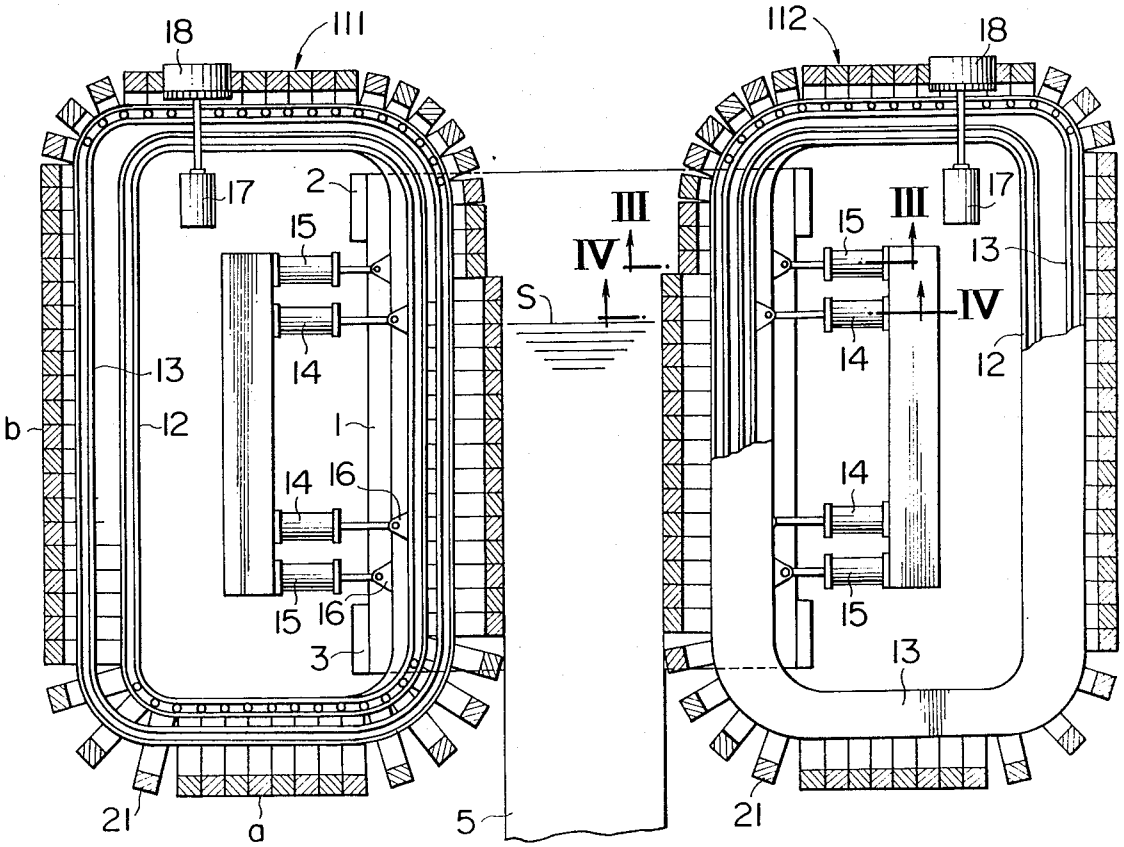
FIG. 2 is a schematic side elevational view of the continuous casting machine shown in FIG. 1 with one of endless belts removed.

Referring to FIGS. 1 and 2, a continuous casting machine 100 is disposed under a tundish 101 and receives molten metal (steel, for example) discharged from the tundish through a pouring nozzle 102 thereof to continuously produce a thin slab 5 which is continuously drawn from the casting machine 100 and runs towards another treatment apparatus, not shown, while the slab is supported by a series of support rolls.

The casting machine 100 has a pair of endless belts 1 (only one of which is shown in FIGS. 1 and 2) of a metal and a pair of endless movable loops 111 and 112 each comprising a plurality of side dam members 21 to be described later. Each of the metallic belts 1 extends around three pulleys; an upper tension pulley 2, a lower driving pulley 3 and an idle pulley 4, and has a substantially vertical run extending between the tension pulley 2 and the driving pulley 3. The vertical runs of the two metallic endless belts 1 are horizontally spaced a distance corresponding to the thickness of the slab 5 to be cast. The metallic belts 1 are known per se and disclosed in the Japanese Unexamined Patent Publication No. 61-279,341 referred to above and, thus, will not be described in more detail herein.

The pair of movable loops 111 and 112 have vertically extending parallel runs sandwitched between the parallel and vertical runs of the metallic belts 1 and movable in a direction the same as that of the movements of the vertical runs of the metallic belts and in synchronism therewith. The vertical runs of the metallic belts 1 and the vertical runs of the movable endless loops 111 and 112 cooperate together to define therebetween a mold cavity of a substantially rectangular cross-section into which the molten steel is poured. Side dam members 21 of the movable loops 111 and 112 form the two short sides of the substantially rectangular cross-section of the mold cavity. It is to be noted that the term "substantially rectangular" used herein means a cross-sectional shape including not only the basic rectangular shape but also somewhat modified shapes of rectangle, such as a somewhat rounded rectangle with its corners rounded or bevelled or with the two short sides having recesses or projections of arcuate cross-sections, or a shape which is called by "beam blank" in the art. Each of the side dam members 21 is of a block-like configuration and thus referred to hereinunder as "short-side mold block".

The metal poured into the mold cavity is in a molten state in an upper part of the mold cavity, as shown by a meniscus S. As the molten metal is moved downwards in the mold cavity, the molten metal is gradually solidified until the metal forms a slab 5 having solidified surfaces and drawn downwardly from the mold cavity.

Each of the movable loops 111 and 112 includes first and second groups a and b of short-side mold blocks which are guided by inner and outer guide rails 12 and 13 each of which is basically of a shape of substantially rectangular closed loop. Each guide rail must be linear in its part facing the slab but may be of any shape in its other parts provided the shape varies gradually. The shape of each guide rail, therefore, is not limited to rectangle. It is usual that each guide rail has rounded corners to assure smooth movements of the short-side mold blocks at the corners.

In the zones adjacent to the mold cavity, the inner and outer guide rails 12 and 13 are independently movable widthwise of the metallic belts 1 and thus of the slab 5 by rail moving means in the form of fluid pressure cylinders 14 and 15, respectively, as will be described in more detail later. The cylinders 14 and 15 have forward ends respectively connected through brackets 16 to the inner and outer guide rails 12 and 13, while the bases of the cylinders 14 and 15 are secured to a machine frame which can be either fixed or adjustable stepwise to adjust the initial positions of the guide rails 12 and 13.

Figure 3:
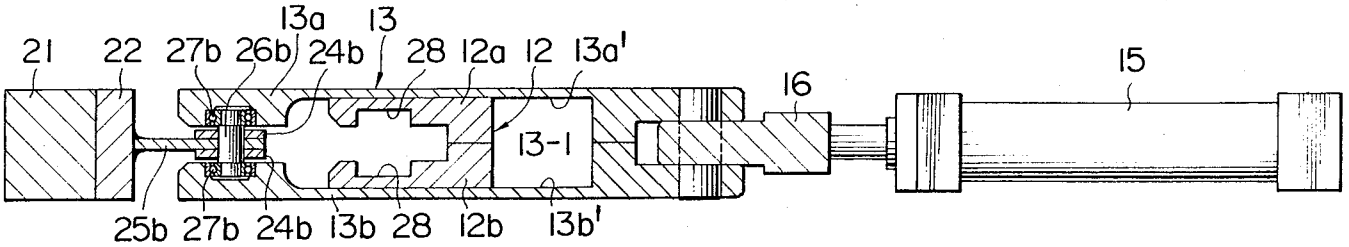
FIGS. 3 and 4 are cross-sectional views of the continuous casting machine taken along lines III—III and IV—IV in FIG. 2, respectively.
Figure 4:
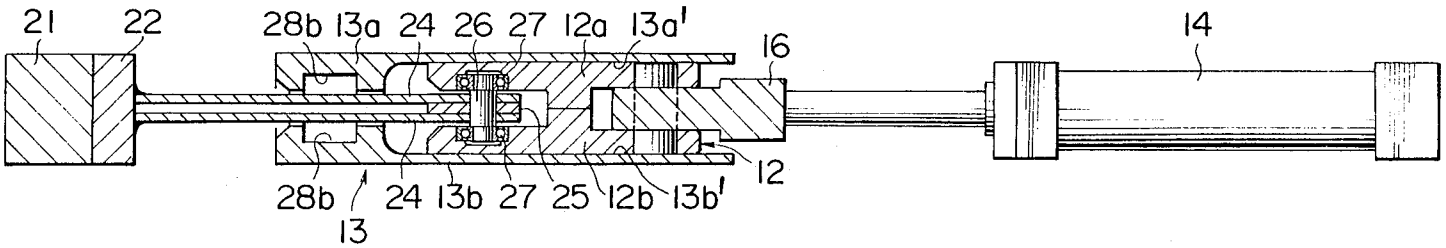

Referring now to FIGS. 3 and 4, the portion of the outer guide rail 13 adjacent to the mold cavity is formed by a pair of upper and lower plate-like channel members 13*a* and 13*b* superposed one on the other and secured together. These channel members 13*a* and 13*b* have inner surfaces respectively formed therein with vertically aligned recesses 13*a*′ and 13*b*′ and vertically aligned grooves 28 and 28*b*. The grooves 28*a* and 28*b* are disposed adjacent to the side edge of the outer guide rail 13 that is adjacent to the mold cavity, while the recesses 13*a*′ and 13*b*′ are disposed adjacent to the other side edge of the outer guide rail 13. The two recesses 13*a*′ and 13*b*′ cooperate to a space 13-1. The cylinders 15 are connected through the brackets 16 to the side edge of the outer guide rail 13 that is adjacent to the space 13-1. The inner guide rail 12 is disposed in the space 13-1 in the outer guide rail 13 for sliding movement widthwise of the slab 5.

The inner guide rail 12 is also formed by a pair of upper and lower plate-like channel members 12*a* and 12*b* superposed one on the other and secured together. These channel members 12*a* and 12*b* have inner surfaces formed therein with vertically aligned grooves 28 disposed adjacent to the side edge of the inner guide rail 12 that is adjacent to the mold cavity. The cylinders 14 are connected to the other side edge of the inner guide rail 12 remote from the grooves 28.

Figure 2A:
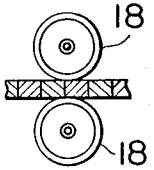
FIG. 2A is a fragmentary top plan view of an endless loop of short-side dam blocks and driving means therefor both shown in FIG. 2.
Figure 5:
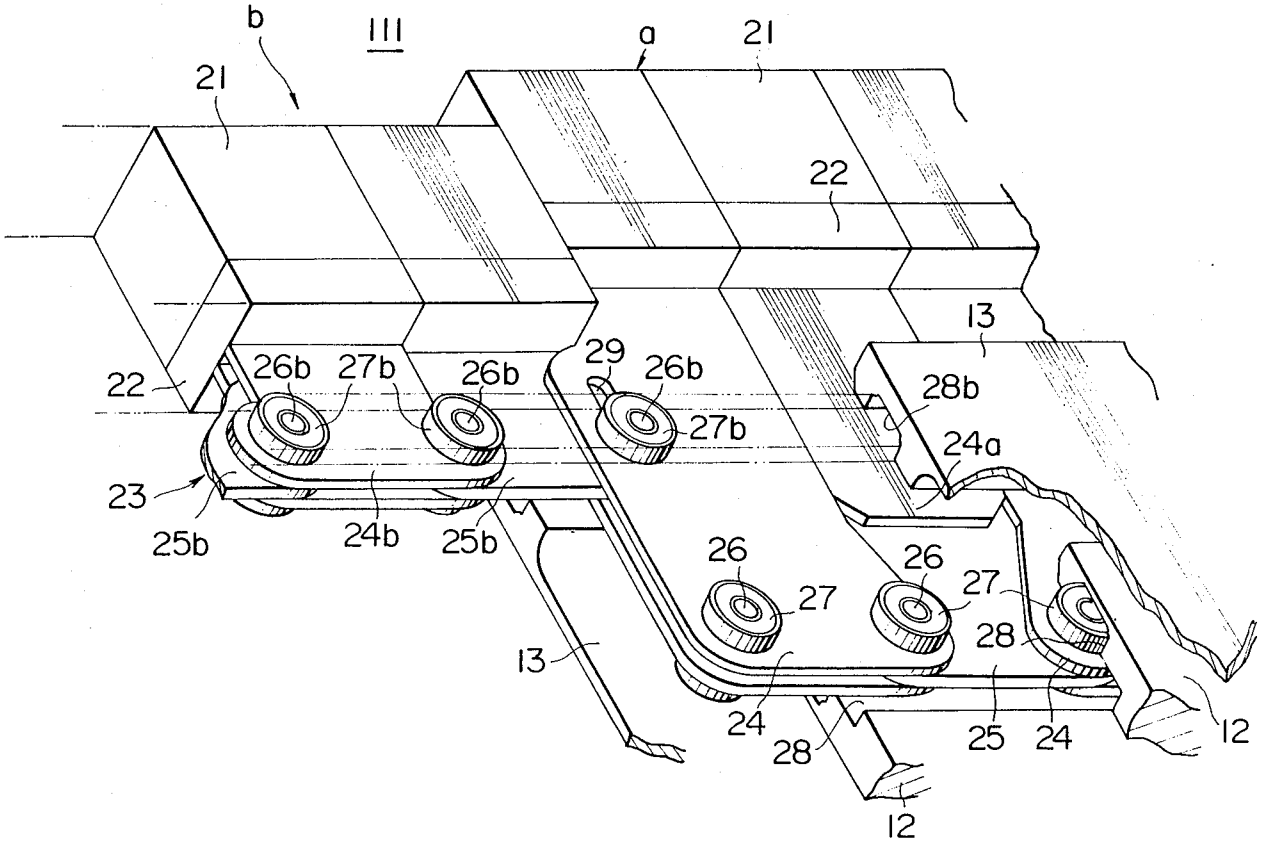
FIG. 5 is an fragmentary perspective view of an endless chain supporting the short-side dam blocks and guide rails engaged with the chain.

As shown in FIG. 5, each of the first and second short-side mold block groups a and b of each of the movable loops 111 and 112 comprises a plurality of short-side mold blocks 21 which are mounted on the endless chain 23 by means of mounting members 22. The endless chain 23 and the mounting members 22 cooperate to constitute short-side mold block support means. Thus, when the endless chains 23 are moved lengthwise thereof, the short-side mold blocks 21 of the respective loops 111 and 112 are moved with the chains 23, respectively. These movements are caused by driving means constituted by motors 17 provided for the loops 111 and 112 and driving wheels 18 rotated by the motors 17. The driving wheels 18 may be rollers disposed in driving engagement with the opposite sides of the short-side mold blocks 21 of the loops 111 and 12 and/or the mounting members 22, as shown in FIG. 2A. Alternatively, the driving wheels 18 may be pinions and/or combinations of pinions and rollers disposed in driving engagement with the loops 111 and 112.

The loop driving means are not essential for the invention because the endless loops of the side dam members can be moved by the endless belts or by the slab being cast.

When either the inner guide rails 12 or the outer guide rails 13 for the movable loops 111 and 112 moved by the cylinders 15 or 14 widthwise of the metallic belts 1 in the zones adjacent to the metallic belts 1, the paths of the movements of the short-side mold blocks 21 of the loops 111 and 112 in these zones are shifted widthwise of the metallic belts 1 to vary the width of the slab 5 to be cast.

The connection between each chain 23 and associated short-side mold blocks 21 will be described hereunder with reference to FIGS. 3–6. The part of the chain 23 which carries the short-side mold blocks 21 of the first group a includes many link units each having a first link member 25 extending in the longitudinal direction of the chain 23. The link member 25 has an outer edge to which is connected a tongue **24*a* extending from the mounting member 22 of one shortside mold block 21. To one end of the first link member 25 are pivotally connected, by a pin 26, a pair of upper and lower second elongated tongue-like link members 24 which extend inwardly of the loop 111 beyond the tongue 24*a* from the mounting member 22 of a short-side mold block 21 disposed adjacent to one side of said one short-side mold block 21. In other words, the one end of the first link member 25 is sandwitched between and pivotally connected by the pin 26 to the pair of upper and lower second link members 24 to cooperate therewith to form a link unit. To the other end of the first link member 25 is pivotally connected by another pin 26 another second link member 24 which extends from another mounting member 22 of a short-side mold block 21 disposed adjacent to the other side of said one short-side mold block 21. To the said another second link member 24 is pivotally connected by another pin 26 another first link member 25** to cooperate therewith to form a second link unit. As such, successive link units are formed and pivotally connected in series.

Instead of connecting the first link member 25 to the said one short-side mold block 21 through the shorter tongue **24*a*, the first link member 25 may alternatively be the same in shape as the second link member 24 and connected to the mounting member 22 of the said one short-side mold block 21. In this alternative case, therefore, the two link members 24 and 25 are pivotally connected by a pin 26** to form a link unit.

Rollers 27 are rotatably mounted on the upper and lower ends of each pin 26 which pivotally connects the link members 24 and 25 of each link unit. These rollers 27 are received in the inner guide grooves 28 in the inner guide rail 12 and movable along the guide grooves (see FIGS. 4 and 5).

In the group b of the short-side mold blocks 21 of the loop 111, a third link member **25*b* a short tongue-like shape extends from the mounting member 22 of one short-side mold block 21 inwardly of the loop 111. A pair of upper and lower fourth link members 24*b* each of a short tongue-like shape extends inwardly of the loop 111 from the mounting member 22 of another short-side mold block 21 adjacent to said one short-side mold block 21 and pivotally connected by a pin 26*b* to the third link member 25*b* to form a link unit. A plurality of such link units are formed by third and fourth link members and successively pivotally connected by pins 26*b*. Rollers 27*b* are rotatably mounted on the upper and lower ends of the pins 26*b***.

At the junction between the two groups a and b of the short-side mold blocks 21, the short link member 25 at the end of the short-side mold block group b is inserted into the space between the long upper and lower link members 24 at the end of the short-side mold block group a and pivotally connected to the link members 24 by another pin **26*b*. Rollers 27*b* are also rotatably mounted on the upper and lower ends of the other pin 26*b*. All the rollers 27*b* are received in the outer guide grooves 28*b* in the outer guide rail 28** and guided thereby.

Figure 6:
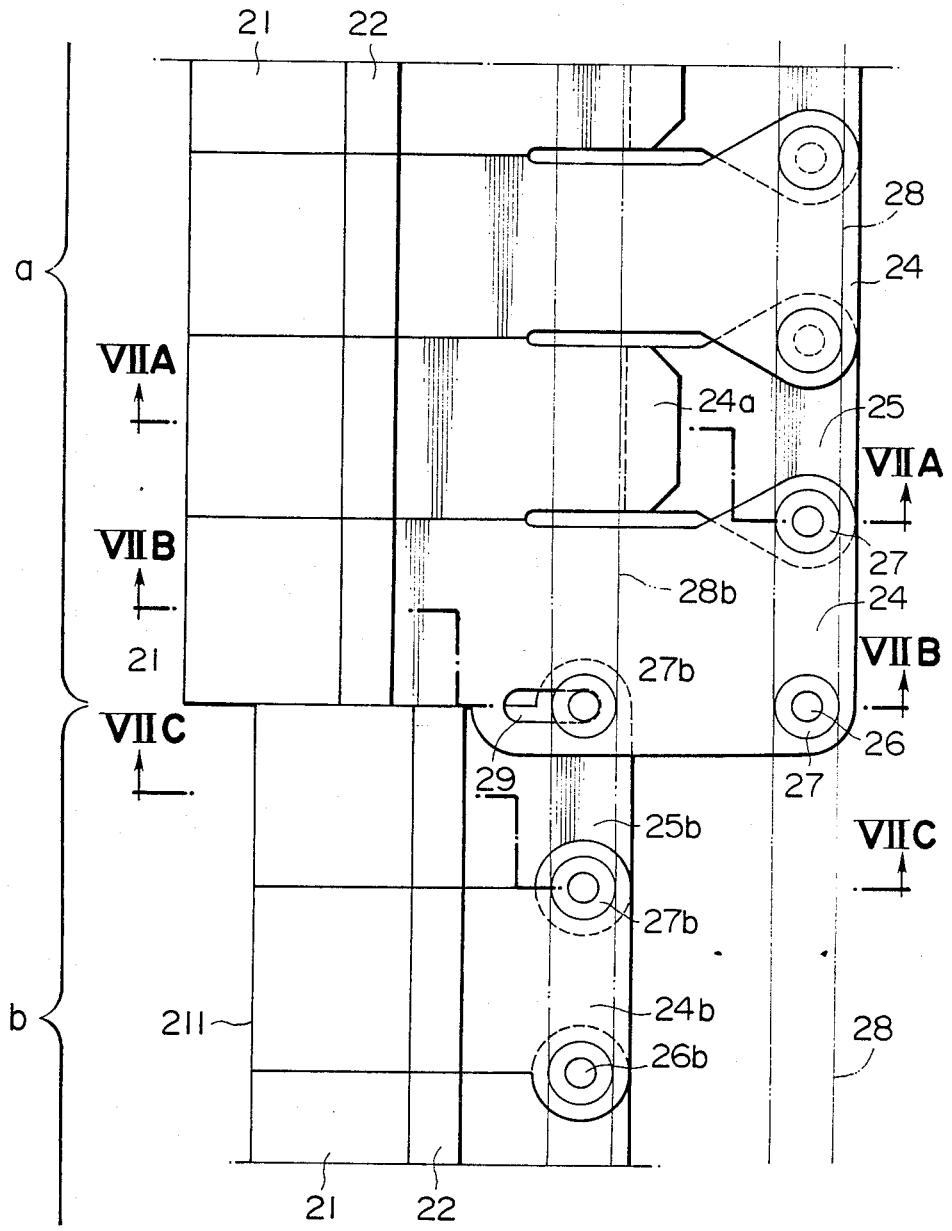
FIG. 6 is an enlarged fragmentary side elevational view of those parts of the endless loop of the short-side dam blocks and the endless chain which are shown in FIG. 5.

It is to be noted that the long link member 24 at the end of the short-side mold block group a is formed therein with a pin-hole in the form of an elongated slot 29 through which extends a pin **26*b* which pivotally connects the link members 24 and 25*b* at the junction between the two groups a and b of the short-side mold blocks 21 (see FIG. 6). The slot 29 and the pin 26*b* extending therethrough form a lost motion connection which allows the short-side mold block 21 at the end of the short-side mold block group a is movable or shiftable relative to the short-side mold block group b in a direction perpendicular to the direction of movement of the chain 23, i.e., widthwise of the slab 5** to be cast.

The short-side mold blocks 21 of the rotatable loops 111 and 112 are preferably made from a copper alloy. Because such mold blocks 21 are placed in intimate contact with side edge portions of the two metallic belts 1 to cooperate therewith to define the mold cavity, it is preferred that the driving means 18 which drives the loops 111 and 112 of the short-side mold blocks 21 in the same direction as the movements of the metallic belts 1 be so designed as not to wear the short-side mold blocks 21 of the loops 111 and 112. It is also preferred that the driving means 18 be so structured as to drive those short-side mold blocks 21 and mounting members 22 which are placed outside the outer guide rail 13.

To vary the width of a slab 5 during a continuous casting thereof by use of the casting machine described above and in the case where the amount of the width-variation is less than the dimension of each short-side mold block measured in the widthwise direction of the slab can be conducted as follows:

When all of the short-side mold blocks 21 of the group b are out of contact with the slab 5 being cast, only the outer guide rails 13 is moved in a direction widthwise of the slab 5 while the inner guide rail 12 engaged with the short-side mold blocks 21 of the group a is kept at its initial position. Thus, when the short-side mold blocks 21 of the group b are moved to positions where they contact the slab 5, the short-side mold block group b is shifted relative to the short-side mold block group a. After a half a cycle of operation, i.e., when all the short-side mold blocks 21 of the group a are moved to positions where they are out of contact with the slab 5, the inner guide rail 12 is moved in the same direction and by the same distance as those of the preceding movement of the outer guide rail 13 while the outer guide rail 13 is kept stationary, to thereby complete the width-varying movements of the first and second groups a and b of short-side mold blocks 21. The continuous casting machine after the width-varying adjustment produces the slab 5 with the width thereof varied by a dimension corresponding to the amounts of the width-varying movements of the guide rails of the two loops of short-side mold blocks.

Contrary to the above-described width-varying operation, when all the short-side mold blocks 21 of the group a are in positions where they are out of contact with the slab 5 being cast, only the inner guide rail 12 is moved widthwise of the slab 5 while the outer guide rail 13 engaged with the short-side mold blocks 21 of the group b is kept stationary. Thus, when the short-side mold blocks 21 of the group a are moved to positions where they are in contact with the slab 4, these mold blocks 21 are shifted relative to the short-side mold block group b by a distance equal to the amount of movement of the inner guide rail 12. After a half a cycle of operation, a width-varying operation is effected for the short-side mold blocks 21 of the group b by the same dimension and in the same direction as those of the short-side mold block group a to complete the width-varying movements of the two groups a and b of the short-side mold blocks 21. The machine after the width-varying adjustment produces the slab 5 having a width varied by a dimension corresponding to the amounts of the width-varying movements of the guide rails for the two loops of the short-side mold blocks 21.

In the case where the amount of change of the strip-width is greater than the dimension of each of the short-side mold blocks 21, because the amount of the slab width varying movement of each loop achieved by one adjustment operation is within the dimension of the largest short-side mold blocks measured widthwise of the slab, the width-varying adjustment operations described above will be repeated until the total of the amounts of width-varying movements of the group a of mold blocks 21 and the total of the width-varying movements of the group b of mold blocks 21 reach the desired amount of width-varying adjustment.

Figure 7A:
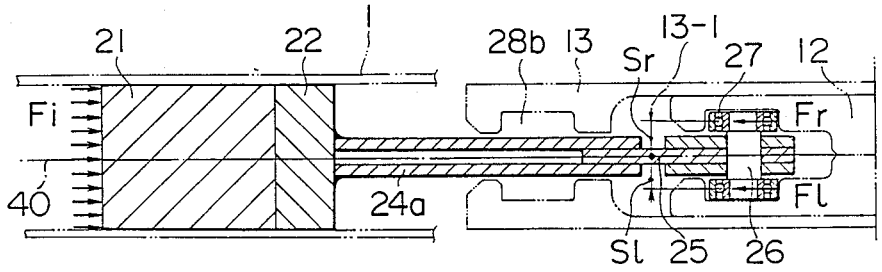
FIGS. 7A-7C are sections taken along lines VIIA—VIIA, VIIB—VIIB and VIIC—VIIC in FIG. 6, respectively.
Figure 7B:
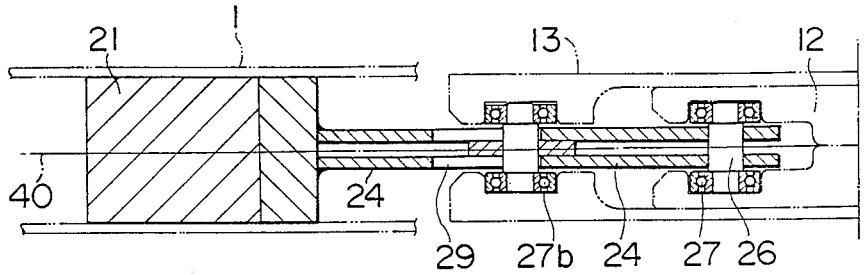
Figure 7C:
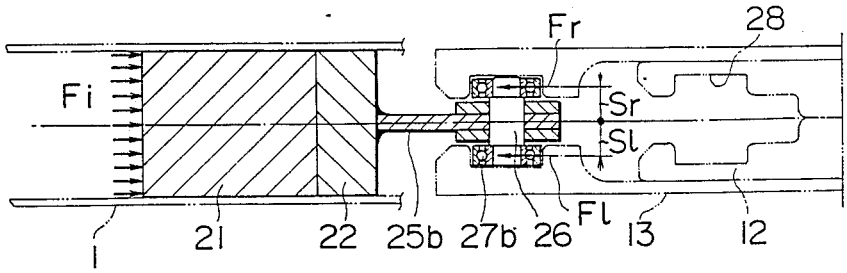

Referring to FIGS. 7A–7C, the molten steel or cast slab 5 in the mold cavity applies in the widthwise direction of the slab 5 a pressure Fi to the short-side mold blocks 21 which are faced to the mold cavity. This pressure acts uniformly on the entire area of the inner surface of each of these mold blocks 21. In the case of the short-side mold blocks 21 of the group a, the pressure Fi is transmitted from each mold block 21 to the inner guide rail 12 either through associated mounting block 22, tongue 25*a*, link member 25, pin 26 and left and right rollers 27 (in the case shown in FIG. 7A) or through associated mounting member 22, link members 24, pin 26 and left and right rollers 27. In other words, the left and right rollers 27 receive reaction forces Fl and Fr from the side faces of the associated guide grooves 28 in the inner guide rail 12. Because the total of the reaction forces Fl and Fr is equal to the pressure Fi, they can be represented by:

$$Fi = Fl + Fr \quad (3)$$

The centers of the left and right rollers 27 associated with each short-side mold block 21 are respectively spaced by distances Sl and Sr from a plane 40 which extends substantially parallel to the direction of the pressure Fi and through the center of the thickness of the short-side mold block 21. Thus, the reaction forces Fl and Fr generated a first moment ($Fl \times Sl$) and a second moment $Fr \times Sr$). Because these moments are equal, they can be represented by:

$$Fl \times Sl = Fr \times Sr \quad (4)$$

If the above equations (3) and (4) are not met simultaneously, there will be generated unbalanced forces which cause wears in localized portions of the machine, produce noises and generate heat at localized portions of the machine.

The two equations (3) and (4) are simultaneously met in the continuous casting machine according to the described embodiment of the invention because the component parts of the machine which bear the pressure Fi and the reaction forces Fl and Fr are all arranged symmetrically with respect to the plane 40. This symmetrical arrangement is achieved by disposing the inner guide rail 12 in the space 13-1 in the outer guide rail 13 so that the grooves 28 and 28*b*, which guide the rollers 27 and 27*b* of the chain 23 and hence the short-side mold blocks 21, are offset widthwise of the slabe 5 to be cast. In addition, because the inner and outer guide rails 12 and 13 are disposed such that their outer surfaces and inner surfaces are in slidable contact with each other, the inner and outer guide rails mutually reinforce and back up even if a force component acts on the guide rails 12 and 13 in a direction perpendicular to the plane 40.

The equations (3) and (4) are also simultaneously met by the structural arrangement of the short-side mold block 21 of the group b, the chain link member 25*b* supporting the mold block, the left and right rollers 27*b* and the outer guide rail 13 bearing and guiding the rollers, all shown in FIG. 7C. Thus, the arrangement shown in FIG. 7C also provides advantages similar to those described in the preceding paragraph.

Moreover, the arrangement which is symmetrical with respect to the plane 40 makes it possible to minimize the dimension of the outer guide rail measured between the opposite side faces thereof, i.e., the dimension of the outer guide rail measured in the direction of the thickness of the slab 5. In fact, the dimension of the outer guide rail measured in the direction of the thickness of the slab is less than the dimension between the two vertical runs of the metallic belts 1, so that the short-side mold blocks, the support means therefor, the inner and outer guide rails and the rods of the rail moving means can be inserted into the gap between the two vertical runs of the metallic belts, as will be seen from FIGS. 7A–7C, with a resultant advantage that the range of dimension over which the slab width can be varied can be maximized.

The maximum width-varying dimension (allowable width-varying dimension) per each width-varying operation is limited by the dimension (100 mm in the illustrated embodiment of the invention) of each short-side mold block 21 measured in the direction of the width of the metallic belts. The dimension in question of the short-side mold blocks is determined considering the required width-varying dimension per each width varying operation.

Tests were conducted with the continuous casting machine of the described and illustrated embodiment of the invention. The width of the slab 5 was varied forty times within a range of form 10 mm to 80 mm at each side of the slabe while a continuous length of the slab was cast from 2,500 tons of molten metal. It was observed that the slab thus produced was free from any non-constant width portion, from any wrinkle on the slab surfaces and from any double-layered slab surface and that the casting operation was smooth and stable.

While the invention has been described as being applied to a vertical type continuous casting machine, the present invention is applicable to the inclined-pouring type continuous casting machine referred to hereinabove with advantages similar to those obtainable from the described embodiment of the invention.

Another embodiment of the present invention will be described hereunder with reference to FIGS. 8–11 wherein the members and portions the same as or similar to those of the preceding embodiment are designated by the same or similar reference numerals to eliminate repetitions of description.

Figure 8:
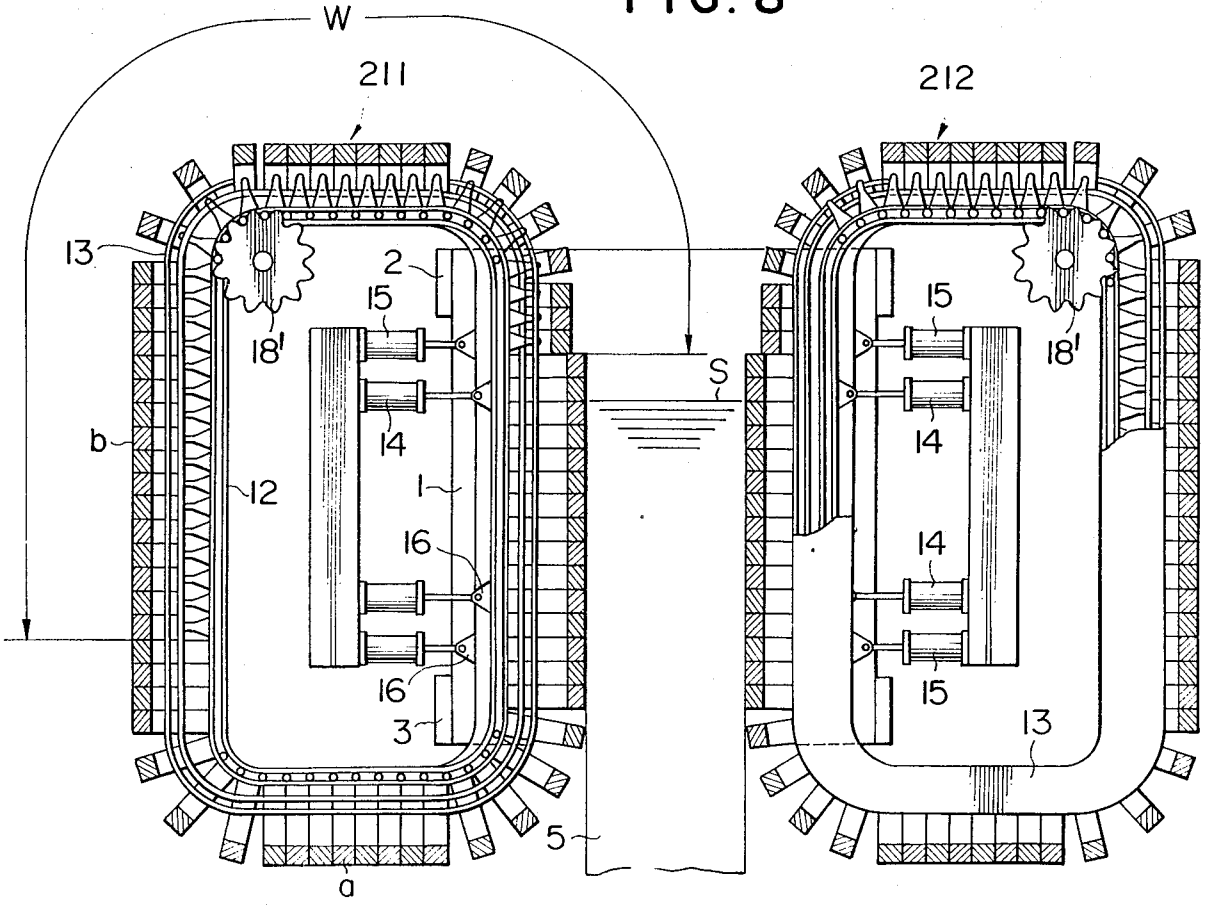
FIG. 8 is similar to FIG. 2 but illustrates a second embodiment of the continuous casting machine according to the present invention.

Referring to FIG. 8, a continuous casting machine has left and right movable endless loops 211 and 212 each comprising a plurality of short-side mold blocks. The movable loops 211 and 212 are driven by sprocket wheels 18' which are arranged for movement with the inner guide rails 12 when the inner guide rails are moved widthwise of the slab being cast. Each inner guide rail 12 is discontinuous only at the portion of the sprocket wheel 18'. The other portions of each inner guide rail 12 extent continuously to cooperate with the sprocket wheel 18' to form a substantially closed loop. Thus, the sprocket wheel 18' functions not only to drive the loop of the short-side mold blocks but also to guide the loop at the portion where the loop is discontinuous.

Figure 9:
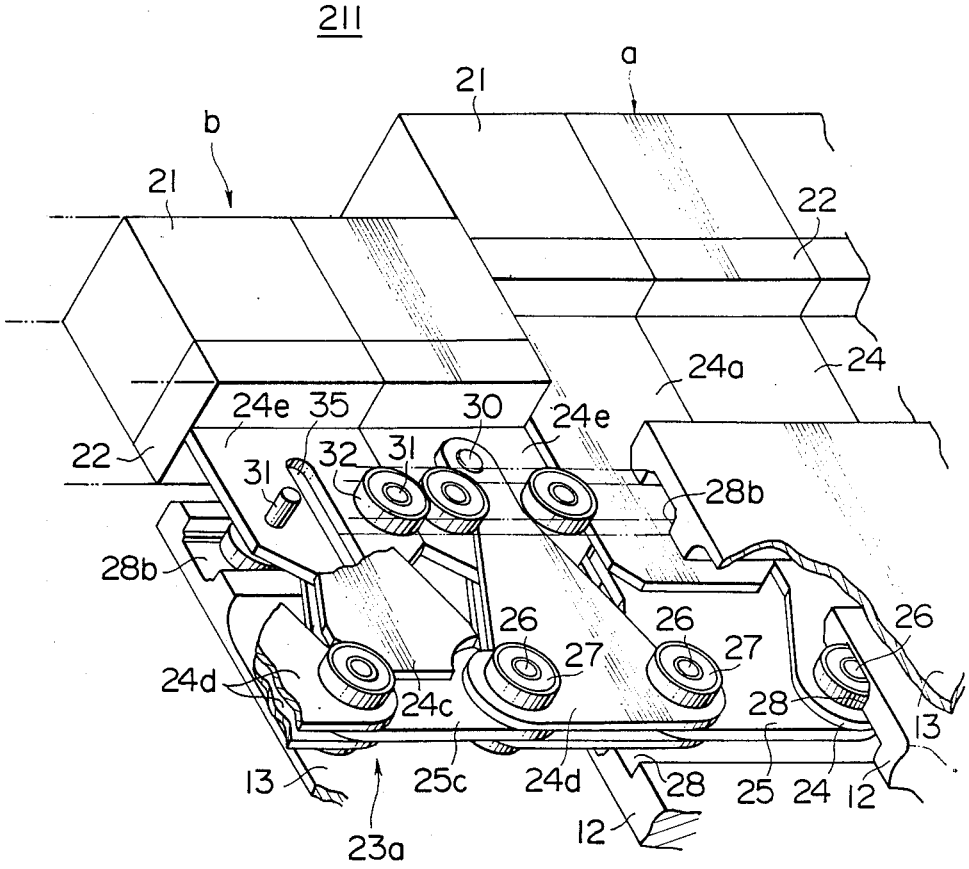
FIG. 9 is similar to FIG. 5 but illustrates the endless chain and the guide rails incorporated in the second embodiment.
Figure 10:
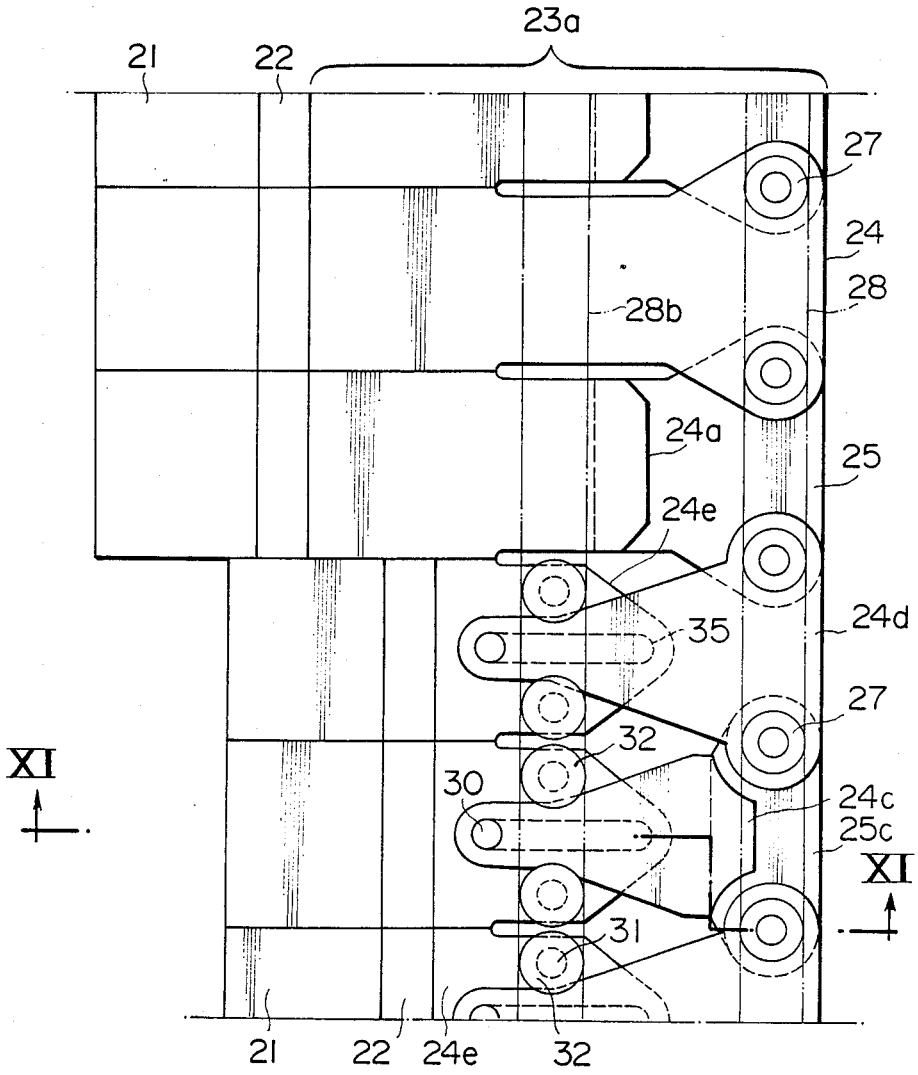
FIG. 10 is similar to FIG. 6 but illustrates the endless chain incorporated in the second embodiment.

Each of the loops 211 and 212 of the short-side mold blocks is supported by an endless chain **23*a* a part of which is shown in FIG. 9. The chain 23*a* is engaged with the inner guide rail 12 over the entire length of the chain and also engaged with the outer guide rail 13 within the range indicated by an arrow W shown in FIG. 8**.

Each of the loops 211 and 212 has first and second groups a and b of short-side mold blocks. The part of the chain **23*a* which supports the first group a of short-side mold blocks is engaged only with the inner guide rail 12, while the part of the chain which supports the group b of the short-side mold blocks is engaged with both of the inner and outer guide rails 12 and 13. This point will be described in more detail hereunder with reference to FIGS. 9 and 10**.

In the group a of the short-side mold blocks, each link unit of the chain **23*a* comprises a first link member 25 and a second link member 24, as in the first embodiment. To the outer side edge of the first link member 25 is secured a tongue 24*a* extending from a mounting member 22 of one short-side mold block 21. The second link member 24 is secured to another short-side mold block 21 adjacent to said one short-side mold block 21. The first and second link members 25 and 24 are pivotally connected by a pin 26 which rotatably carries at its upper and lower ends rollers 27 which in turn are guided by guide grooves 28 formed in the inner guide rail 12**.

Figure 11:
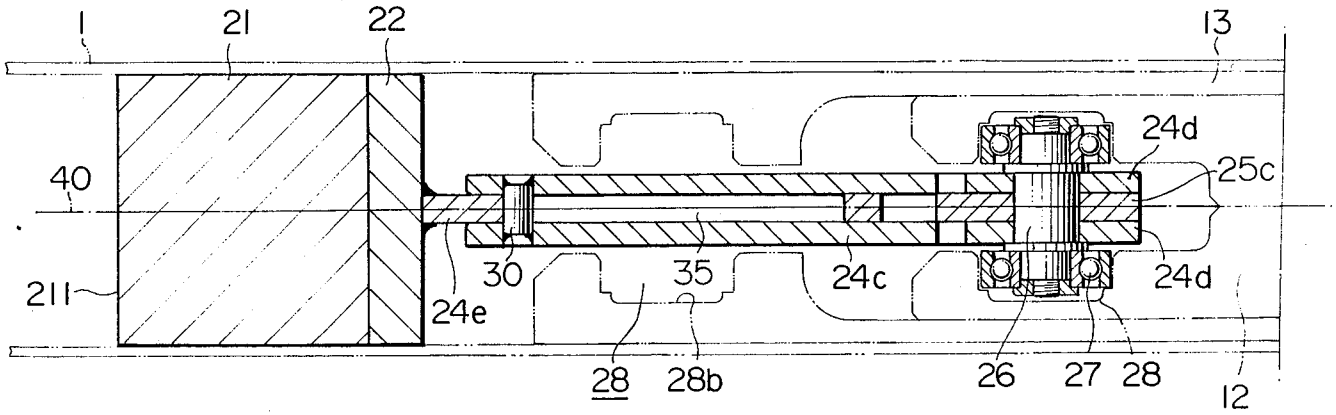
FIG. 11 is a cross-section taken along line XI—XI in FIG. 10.

In the second group b of short-side mold blocks, each link unit of the chain **23*a* comprises a third link member 25*c* and a pair of fourth upper and lower triangular link members 24*d* pivotally connected to the upper and lower surfaces of the third link member 25*c* by another pin 26. A pair of upper and lower triangular tongue 24*c* are secured to the outer edges of the upper and lower surfaces of the third link member 25*c* and extent therefrom outwardly of the loop of the chain. Each of the fourth link members 24*d* have an apex which also extends outwardly of the loop of the chain. From the mounting members 22 of the short-side mold blocks 21, tongues 24*e* extend inwardly of the loop and have formed therein slits 35 each extending perpendicularly to the direction of movement of the chain 23*a*. The apexes of the tongues 24*c* and the fourth link members 24*e* are respectively connected to adjacent tongues 24*e* by pins 30 which extend through the slits 35, as shown in FIG. 11. The combinations of slits 35 and associated pins 30 constitute lost motion connections which allow the short-side mold blocks 21 of the group b to be movable relative to the chain 23*a* in the directions of the slits 35. Pins 31 extend from the upper and lower surfaces of each tongue 24*e* and have free ends on which rollers 32 are rotatably mounted and movably engaged with the guide groove 28*b* in the outer guide rail 13** so as to be guided thereby.

The pair of upper and lower fourth link members **24*d* at the end of the short-side mold block group b are pivotally connected to the upper and lower surfaces of the first link member 25 at the end of the short-side mold block group a by a pin 26 which also rotatably carries at its opposite ends rollers 27 which in turn are engaged with and guided by grooves 28 in the inner guide rail 12**.

Thus, when the inner guide rail 12 is shifted widthwise of the slab being cast, the short-side mold blocks 21 of the group a are also shifted in the same direction as the inner guide rail 12. However, because the movement of the mounting member 22 of each of the short-side mold blocks 21 of the group b is restricted by the guide groove **28*b* in the outer guide rail 13, only the third and fourth link members 25*c* and 24*d* and the tongues 24*c* of the chain 23*a* are moved relative to the short-side mold blocks 21 of the group b. When the outer guide rail 13 is shifted widthwise of the slab being cast, the short-side mold blocks 21 of the group b are shifted relative to the group a of the short-side mold blocks 21 which are prevented by the guide groove 28 in the inner guide rail 12** from being shifted. As such, the width of the slab can be varied as in the first embodiment of the invention.

What is claimed is:

1. A twin belt type continuous casting machine of the type that includes a pair of endless belts movable in the directions of their lengths and a pair of endless loops each formed by a plurality of short-side dam blocks and movable in the direction of the length of the loop, said endless belts having spaced and substantially parallel runs movable in the same directions, said endless loops of dam blocks having spaced and substantially parallel runs each sandwiched between adjacent side edges of said parallel runs of said endless belts and movable substantially in synchronism therewith, said parallel runs of said endless belts and said parallel runs of said endless loops of dam blocks cooperating together to form a continuous casting mold having a substantially rectangular cross-section, said endless belt parallel runs and said endless loop parallel runs constituting the long side faces and the short side faces of the mold, respectively, said mold continuously receiving molten metal to cast a thin and continuous slab, the improvement comprising:

pairs of substantially endless inner and outer guide rails for guiding said endless loops, respectively;

rail moving means for shifting said inner and outer guide rails independently to shift said runs of said endless loops of dam blocks in the widthwise directions of the slab being cast;

each of said pair of endless loops of dam blocks comprising a first group of short-side dam blocks guided by at least one of said inner and outer guide rails of one of the pairs and a second group of short-side dam blocks guided by at least the other guide rail of the one pair, said first and second groups of short-side dam blocks being connected to form said endless loop, said first and second groups of short-side dam blocks being formed by short-side dam blocks of a number extending over a dimension longer than a dimension required for said short-side dam blocks to contact with said slab;

first and second short-side dam block support means for engaging said first and second groups of short-side dam blocks with associated guide rails so that said short-side dam blocks are supported by said guide rails;

said inner and outer guide rails being movable by said rail moving means to respectively shift, through said first and second short-side dam block support means, said first and second groups of short-side dam blocks in directions widthwise of said slab;

said inner and outer guide rails and said first and second short-side dam block support means being arranged such that pressures applied by the metal being cast and by a cast slab to said short-side mold blocks in contact with the metal and said slab are transmitted to said inner and outer guide rails substantially along a plane extending through a substantially thicknesswise center of said slab and substantially in parallel with the widthwise direction of said slab.

2. A twin belt type continuous casting machine according to claim 1, wherein said first and second short-side dam block support means comprise parts of a length of chain, the parts of the chain being connected together by a lost motion connection means to form an endless chain and said lost motion connection means being arranged such that said chain parts are relatively movable in a direction perpendicular to the direction of movement of said chain.

3. A twin belt type continuous casting machine according to claim 1, wherein one of said first and second groups of short-side dam blocks of each loop is guided by said first and second guide rails of one of the pairs, said first and second short-side dam block support means comprise parts of a length of a chain, said chain parts being connected together to form an endless chain, the chain part associated with said one group of short-side dam blocks being expansible and contractible in a direction substantially perpendicular to the direction of movement of said chain.

4. A twin belt type continuous casting machine according to claim 2, wherein said endless chain comprises a plurality of link members pivotally connected in series by pins and rollers rotatably mounted on said link members, said outer guide rail defining therein an inner space opened in a side of said outer guide rail adjacent to said endless chain, said inner space having inner surfaces formed therein with first guide grooves accommodating rollers mounted on the link members of one of said chain parts, said inner guide rail being received in said inner space in said outer guide rail for sliding movement widthwise of said slab, said inner guide rail having formed therein second guide grooves accommodating rollers mounted on the link members of the other chain part.

5. A twin belt type continuous casting machine according to claim 4, wherein said rollers are mounted on the opposite ends of said pins, said lost motion connection means comprises a slot formed in one of the link members at the adjacent ends of said chain parts and a pin mounted on the other link member and extending through said slot.

6. A twin belt type continuous casting machine according to claim 3, wherein said endless chain comprises a plurality of link members pivotally connected in series by pins and a first row of rollers rotatably mounted on said link members, said outer guide rail having formed therein an inner space open in a side of said outer guide rail adjacent to said endless loop of short-side dam blocks, said inner space having inner surfaces formed therein with first guide grooves, said inner guide rail being received in said inner space in said outer guide rail for sliding movement widthwise of said slab and having second guide grooves formed in said inner guide rail, one of said first and second guide grooves receiving said first row of rollers, the short-side dam blocks of one of said first and second groups being fixed to said endless chain, the short-side dam blocks of the other group being so mounted on said endless chain as to be movable in a direction perpendicular to the direction of movement of said endless chain and rotatably supporting a second row of rollers, the rollers of said second row being received in the other of said first and second guide grooves.

7. A twin belt type continuous casting machine according to claim 6, wherein the short-side dam blocks of said other group are connected to the link members of said endless chain by lost motion connection means each comprising a pin and a slot.

8. A twin belt type continuous casting machine according to claim 4, wherein said inner and outer guide rails, said endless chain and said rollers are arranged substantially symmetrically with respect to said plane.

9. A twin belt type continuous casting machine according to claim 6, wherein said inner and outer guide rails, said endless belt and said rollers are arranged substantially symmetrically with respect to said plane.

* * * * *

UNITED STATES PATENT AND TRADEMARK OFFICE

CERTIFICATE OF CORRECTION

PATENT NO. : 4,854,371

DATED : August 8, 1989

INVENTOR(S) : Keiichi Katahira et al

It is certified that error appears in the above-identified patent and that said Letters Patent is hereby corrected as shown below:

On the title page, after "[21] Appln. No.: 287,240", insert:

--[30] Foreign Application Priority Data

Dec. 23, 1987 JP Japan..... 62-328080

Dec. 23, 1987 JP Japan ..... 62-328082--.

Signed and Sealed this

Eleventh Day of December, 1990

*Attest:*

*Attesting Officer*

HARRY F. MANBECK, JR.

*Commissioner of Patents and Trademarks*